US006182407B1

(12) United States Patent
Turpin et al.

(10) Patent No.: US 6,182,407 B1
(45) Date of Patent: Feb. 6, 2001

(54) GYPSUM BOARD/INTUMESCENT MATERIAL FIRE BARRIER WALL

(75) Inventors: Kenneth A. Turpin, Delta (CA); Richard A. Versen, Highlands Ranch, CO (US); Bradley Burdic, Littleton, CO (US); Reed H. Larson, Parker, CO (US); Monroe W. Shumate, Littleton, CO (US)

(73) Assignee: Johns Manville International, Inc., Denver, CO (US)

( * ) Notice: Under 35 U.S.C. 154(b), the term of this patent shall be extended for 0 days.

(21) Appl. No.: 09/220,729

(22) Filed: Dec. 24, 1998

(51) Int. Cl.[7] ..... E04C 2/16; E04C 2/24

(52) U.S. Cl. ..... 52/232; 52/381; 52/383; 52/784.11; 52/787.11; 52/800.12

(58) Field of Search ..... 52/800.12, 787.11, 52/784.11, 232, 381, 383, 787.1; 42/70, 224, 703; 49/321, 501

(56) References Cited

U.S. PATENT DOCUMENTS

| | | | | |
|---|---|---|---|---|
| Re. 34,951 | | 5/1995 | Slosberg et al. . | |
| 1,159,411 | * | 11/1915 | Olberg . | |
| 3,574,644 | | 4/1971 | Olstowski et al. . | |
| 3,642,531 | | 2/1972 | Peterson . | |
| 3,908,062 | * | 9/1975 | Roberts | 428/282 |
| 3,945,962 | | 3/1976 | Clark . | |
| 4,015,386 | * | 4/1977 | Cook | 52/232 |
| 4,043,950 | | 8/1977 | Wilmsen et al. . | |
| 4,191,675 | | 3/1980 | Inagaki et al. . | |
| 4,222,926 | | 9/1980 | Mizuno et al. . | |
| 4,273,879 | | 6/1981 | Langer et al. . | |
| 4,282,687 | * | 8/1981 | Teleskivi | 49/503 |
| 4,284,550 | | 8/1981 | Mizuno et al. . | |
| 4,299,875 | * | 11/1981 | Steele | 428/172 |
| 4,343,127 | * | 8/1982 | Greve et al. | 52/785 |
| 4,563,491 | | 1/1986 | Comune . | |
| 4,571,915 | * | 2/1986 | Barman | 52/785 |
| 4,689,256 | | 8/1987 | Slosberg et al. . | |
| 4,811,538 | * | 3/1989 | Lehnert et al. | 52/455 |
| 5,057,367 | | 10/1991 | Morii et al. . | |
| 5,132,054 | | 7/1992 | Stahl . | |
| 5,175,197 | | 12/1992 | Gestner et al. . | |
| 5,232,976 | | 8/1993 | Horacek et al. . | |
| 5,338,349 | | 8/1994 | Farrar . | |
| 5,481,834 | * | 1/1996 | Kowalczyk et al. | 52/64 |
| 5,498,466 | | 3/1996 | Navarro et al. . | |
| 5,740,635 | * | 4/1998 | Gil et al. | 52/79.1 |
| 5,916,077 | * | 6/1999 | Tang | 49/501 |

* cited by examiner

*Primary Examiner*—Carl D. Friedman
*Assistant Examiner*—Yvonne M. Horton
(74) *Attorney, Agent, or Firm*—John D. Lister

(57) ABSTRACT

A gypsum board/intumescent material fire barrier wall includes spaced apart, vertically extending metal or wooden studs with only one layer of gypsum board secured to each side of the studs to form a fire barrier wall with a wall cavity. An intumescent material barrier, that is at least coextensive in width and height with the width and height of the wall cavity, is also included in the fire barrier wall and preferably, the wall cavity contains a fibrous insulation blanket. Preferably, the spaced apart gypsum wall boards, with the intumescent material barrier, provide the fire barrier wall with two hour fire-resistive properties meeting or exceeding ASTM test standard E119 for walls and partitions.

24 Claims, 2 Drawing Sheets

GYPSUM BOARD/INTUMESCENT MATERIAL FIRE BARRIER WALL

BACKGROUND OF THE INVENTION

The present invention relates to a fire barrier wall which includes an intumescent material, and, in particular, to a two hour fire barrier wall which includes a single layer of gypsum board secured to each side of the studs within the wall and an intumescent material barrier, such as but not limited to: an intumescent coating layer containing expandable particulate graphite applied to the interior or exterior of one or both gypsum board layers; a fibrous insulation blanket, located intermediate the gypsum board layers, with an intumescent material (e.g. an intumescent coating) layer on one or both surfaces of the blanket; a woven or non-woven fibrous mat layer or layers coated with an intumescent coating containing expandable particulate graphite located on the exterior of or intermediate the gypsum board layers; or a woven or non-woven fibrous mat layer or layers with expandable particulate graphite dispersed throughout the mat located on the exterior of or intermediate the gypsum board layers or combinations thereof.

Gypsum board fire barrier walls 120, having two hour performance ratings, are currently constructed, as shown in FIG. 6. As currently constructed, these two hour fire barrier walls 120 include two layers 122 and 124 of vertically extending five-eights of an inch, type X, gypsum wallboard attached by screws to both sides of metal screw or wooden studs 126 that are spaced apart on sixteen or twenty four inch centers. The cavity defined by the interior surfaces of the inner gypsum boards and the studs is filled with an insulation material 128, such as a glass fiber or mineral wool insulation blanket. While performing as required, the use of two layers of gypsum wallboard (each wallboard layer weighing approximately 2200 pounds/thousand square feet) on both sides of the studs in these fire barrier walls adds significantly to the weight to be supported by the structural framework of a building. In addition, the time and labor involved in handling and installing two layers of gypsum wallboard on each side of the studs can add to the construction costs. Thus, there has been a need for an inexpensive, easy to install, gypsum board fire barrier wall with a two hour performance rating that does not require the use of two layers of gypsum wallboard on both sides of the studs.

Intumescent materials, such as those disclosed in U.S. Pat. No. 3,574,644; issued Apr. 13, 1971; Franciszek Olstowski et al (hereinafter "the '644 patent), can be applied (as stated in column 3, lines 1–5 of the '644 patent) in the form of a coating to "normally combustible or heat degradable materials such as wood, fiber-board, plastics, insulative ceilings or wall panels, other cellulosic building materials, or the like" to increase the flame resistance of such normally combustible or heat degradable materials. These intumescent materials form passive fire protection systems which remain inactive until subjected to heat and temperatures such as those encountered from the flames of a fire. When these passive fire protection systems are subjected to heat and temperatures, such as those encountered in a fire, these intumescent materials react, grow and expand forming a char (many times the original thickness of the coating applied) to insulate the surface to which the material is applied from the damaging effects of the heat generated by the fire.

While these materials can be quite effective as fire barriers, these intumescent materials can be corrosive to steel, stainless steel, copper, aluminum and other metals or metal alloys, such as those commonly used in the construction industry. Thus, in applications, where these intumescent materials come in contact with metal components, e.g. metal fasteners such as screws or nails used to secure gypsum board to studs, the metal studs and other metal structural members or utilities such as piping and the like, the use of these intumescent materials can cause corrosion problems and although the disclosure of the '644 patent has been available to the construction industry for over twenty five years, gypsum board fire barrier walls are still constructed, as set forth above and shown in FIG. 6, using two layers of gypsum wallboard on both sides of the studs.

SUMMARY OF THE INVENTION

The gypsum board/intumescent material fire barrier wall of the present invention provides a solution to the need for a single layer gypsum board fire barrier wall. The gypsum board/intumescent material fire barrier wall of the present invention includes spaced apart, vertically extending metal or wooden studs with only one layer of gypsum board secured to each side of the metal or wooden studs to form a fire barrier wall with a series of wall cavities. The fire barrier wall also includes an intumescent material barrier that is at least coextensive in width and height with the wall cavities and preferably, a fibrous insulation material such as but not limited to a glass fiber or mineral wool insulation within the wall cavity. Preferably, the spaced apart gypsum board layers, with the intumescent material barrier, provide the fire barrier wall with two hour fire-resistive properties meeting or exceeding ASTM test standard E119 for walls and partitions.

In the first and second embodiments of the invention, the intumescent material barrier includes one or two intumescent coating layers, containing expandable particulate graphite, applied directly to the interior and/or exterior of one or both major surfaces of both of the gypsum boards. The coating layer or layers can be applied at the factory or at the job site. Preferably, the intumescent coating layers are coextensive in width and height with the major surfaces of gypsum boards to which the layers are applied so that the intumescent material layer overlays the outer sidewall surfaces of the metal or wooden studs to which the gypsum boards are affixed.

In a third embodiment of the present invention, the intumescent barrier includes one or two intumescent coating layers, containing expandable particulate graphite, applied directly to the one or two major surfaces of a fibrous insulation blanket, such as a glass fiber or mineral wool insulation blanket. The intumescent coating layer or layers on the major surfaces of the fibrous insulation blanket not only provide the intumescent material barrier required for the fire barrier wall, but the intumescent material layers may also enhance the product by stiffening the fibrous insulation blanket (batt) to make the blanket easier to handle and install and by encapsulating the fibers of the fibrous insulation blanket to reduce the exposure of fibers. The coating layer or layers can be applied at the factory or at the job site. The intumescent barrier formed by the coated fibrous insulation is coextensive in width and height with the cavity formed by the gypsum board layers and studs and may overlay the inner sidewall surfaces of the studs to which the gypsum board layers are affixed. Where the intumescent curtain or mat layers do not overlay the inner sidewall surfaces of the studs to which the gypsum board layers are affixed, the outer sidewall surfaces of the studs may be coated with an intumescent material layer.

In a fourth embodiment of the present invention, the intumescent material barrier may be a woven or non-woven fibrous mat layer or layers with an intumescent coating containing expandable particulate graphite or a woven or non-woven fibrous mat layer or layers with expandable particulate graphite dispersed throughout the mat. When applied as a coating, the coating layer or layers can be applied at the factory or at the job site. Such an intumescent material layer or layers can be sandwiched between fibrous insulation layers within the wall cavity; applied intermediate a fibrous insulation layer and the inner major surface of one or both gypsum boards; or applied to the exterior major surface of one or both gypsum boards. The intumescent material coated or containing mat layer(s) are coextensive in width and height with the cavity formed by the gypsum board layers and studs and may overlay the outer sidewall surfaces of the studs to which the gypsum board layers are affixed. Where the intumescent material coated or containing mat layers do not overlay the outer sidewall surfaces of the studs to which the gypsum board layers are affixed, the outer sidewall surfaces of the studs may be coated with an intumescent material layer.

In a preferred embodiment of the present invention, the expandable particulate graphite containing intumescent material used in the fire barrier wall is non-acidic (has a pH greater than 7.0) and contains a corrosion inhibitor so that the corrosion of metals such as gypsum board fasteners and metal studs by the intumescent material is greatly reduced or eliminated.

DESCRIPTION OF THE PREFERRED EMBODIMENTS

As shown in FIGS. 1, 2, 3 and 5, the gypsum board/intumescent material fire barrier wall of the present invention 20*a*, 20*b*, 20*c* and 20*d* includes spaced apart, vertically extending metal or wooden studs 22 with only one layer of gypsum board 24 and 26 secured to each side of the studs by metal screws or other conventional mechanical fasteners to form a fire barrier wall with a wall cavity. The fire barrier wall also includes an intumescent material barrier that is at least coextensive in width and height with the wall cavity and preferably, a fibrous insulation material such as but not limited to a glass fiber or mineral wool insulation within the wall cavity. Preferably, the spaced apart gypsum board layers, with the intumescent material barrier, provide the fire barrier wall with two hour fire-resistive properties meeting or exceeding ASTM test standard E119 for walls and partitions.

Figure 1:
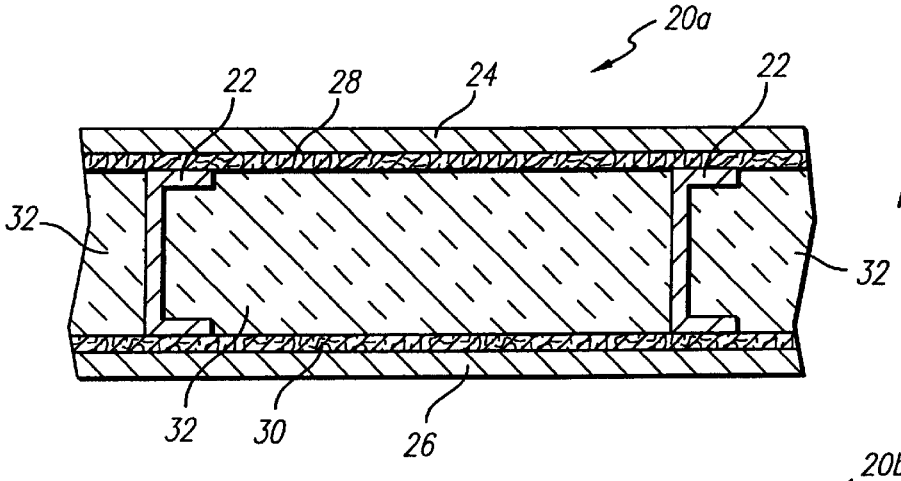
FIG. 1 is a partial transverse horizontal cross section through an embodiment of the gypsum board/intumescent material fire barrier wall of the present invention wherein there are intumescent material layers on or adjacent the interior or inner major surfaces of the two gypsum board layers and overlaying the metal studs.

In the first embodiment 20*a* of the gypsum board/intumescent material fire barrier wall of the invention shown in FIG. 1, the intumescent material barrier includes two intumescent material layers 28 and 30, containing expandable particulate graphite, applied directly to the interior or inner major surfaces of both of the gypsum board layers. The intumescent material layers 28 and 30 may be coating layers of intumescent material, woven or non-woven fibrous mat layers coated with intumescent material, or woven or non-woven fibrous mat layers having intumescent material dispersed throughout the mat. Preferably, the fire barrier wall 20*a* also includes a fibrous insulation layer, such as but not limited to a glass fiber or mineral wool insulation blanket or batt 32, which is coextensive in height and width with the cavity defined by the studs 22 and the gypsum board layers 24 and 26 and preferably extends into the channels of the studs 22 when channel shaped studs are used. The preferred intumescent materials used in the gypsum board/intumescent material fire barrier wall 20*a* and the other fire barrier walls of the present invention will be discussed in detail below.

Preferably, the intumescent material layers 28 and 30 are coextensive in width and height with the major surfaces of gypsum boards 24 and 26 to which the intumescent material layers are applied so that the intumescent material layers overlay the outer sidewall surfaces of the studs 22 to which the gypsum boards are affixed by passing screws through the gypsum boards and intumescent material layers and into the sidewalls of the studs. With this construction the intumescent material barrier of the fire barrier wall 20*a* also protects the metal studs from the effects of flames and heat. While metal studs are shown in FIG. 1, the studs can be wooden studs.

Preferably, where the intumescent material layers 28 and 30 are coating layers, the intumescent material layers range from about 15 mils to about 50 mils in thickness. These coating layers 28 and 30 may be applied in various ways, such as but not limited to, spraying the major surfaces of the gypsum boards with the intumescent coating material at the job site or at the factory or using a doctor blade on a production line to level out and set the thickness of a pool of the intumescent coating material distributed on the major surface of the gypsum board being coated prior to passing the gypsum board beneath the doctor blade. While it is preferred to coat the major surfaces of the gypsum boards in the embodiment of FIG. 1, the intumescent material layers 28 and 30 may also be a woven or non-woven fibrous mat coated with an intumescent material coating or a woven or non-woven fibrous mat, e.g. a mat formed by a wet process, with expandable particulate graphite dispersed throughout the mat.

Figure 2:
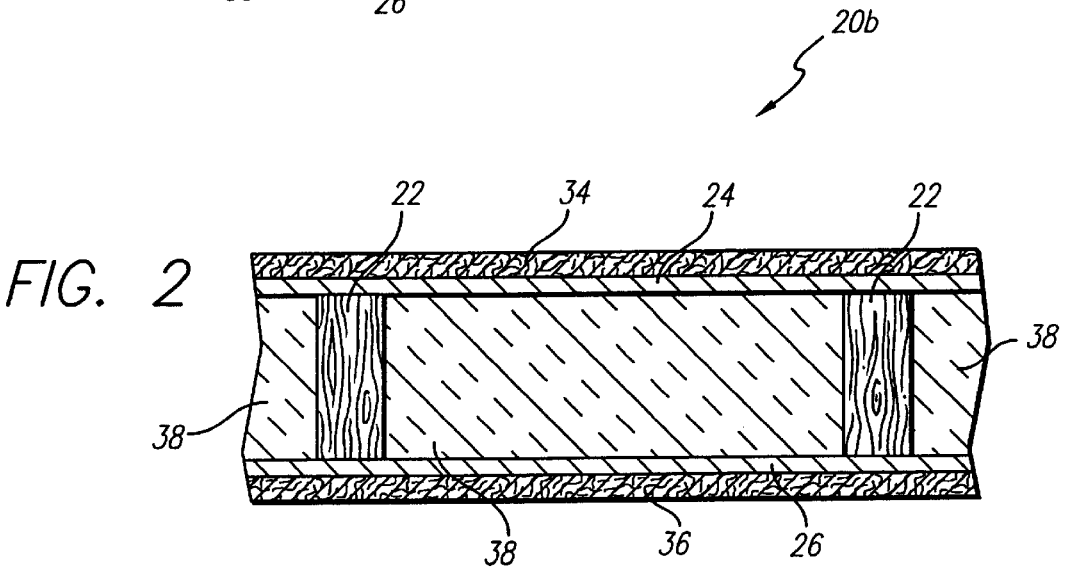
FIG. 2 is a partial transverse horizontal cross section through an embodiment of the gypsum board/intumescent material fire barrier wall of the present invention wherein there are intumescent material layers on the outer or exposed major surfaces of the two gypsum board layers and overlaying the wooden studs.

In the second embodiment 20*b* of the gypsum board/intumescent material fire barrier wall of the invention shown in FIG. 2, the intumescent material barrier includes two intumescent material layers 34 and 36, containing expandable particulate graphite, applied directly to the exposed or outer major surfaces of both of the gypsum boards. The intumescent material layers 34 and 36 may be coating layers of intumescent material, woven or non-woven fibrous mat layers coated with intumescent material, or woven or non-woven fibrous mat layers having intumescent material dispersed throughout the mat. Preferably, the fire barrier wall 20*b* also includes a fibrous insulation layer, such as but not limited to a glass fiber insulation blanket or batt 38, which is coextensive in height and width with the cavity defined by the studs 22 and the gypsum board layers 24 and 26 and preferably, extends into the channels of the studs 22 when channel shaped studs are used. Preferably, the intumescent material layers 34 and 36 are coextensive in width and height with the major surfaces of gypsum boards 24 and 26 to which the intumescent coating layers are applied so that the intumescent material layers overlay the outer sidewall surfaces of the wooden studs 22 to which the gypsum boards are affixed by passing screws through the intumescent material layers and the gypsum boards and into the sidewalls of the studs. With this construction the intumescent material barrier of the fire barrier wall 20*b* also protects the wooden studs from the effects of flames and heat. While wooden studs are shown in FIG. 2, metal studs can be used.

Figure 3:
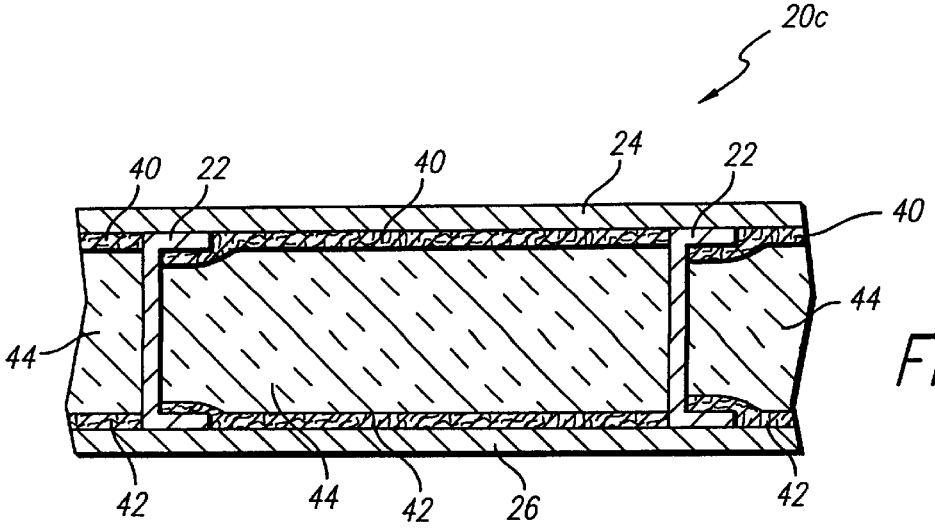
FIG. 3 is a partial transverse horizontal cross section through an embodiment of the gypsum board/intumescent material fire barrier wall of the present invention wherein there is a fibrous insulation blanket with intumescent layers on both major surfaces of the blanket that overlay inner sidewalls of the metal studs.
Figure 4:
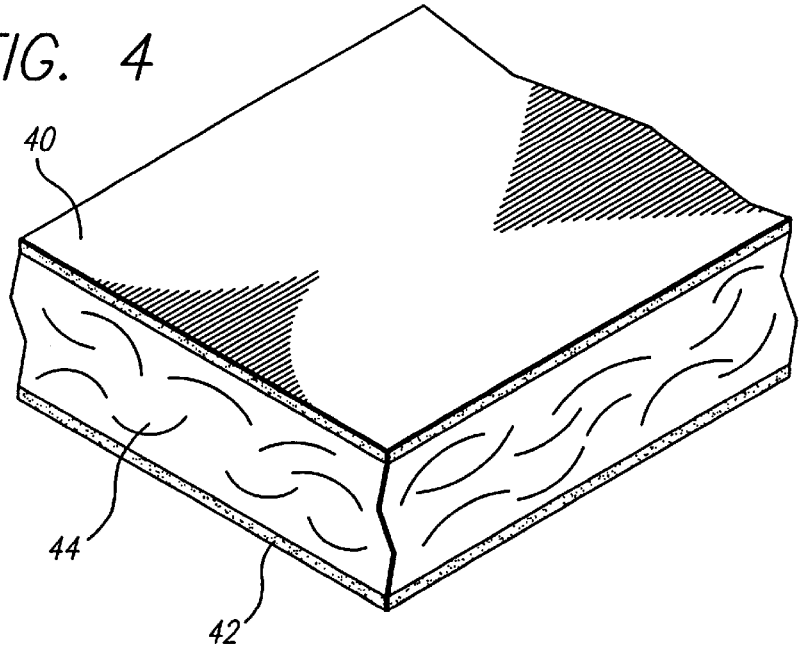
FIG. 4 is a partial perspective view of the coated fibrous insulation blanket or batt used in the fire barrier wall of FIG. 3.

Preferably, the intumescent material layers 34 and 36 are coating layers of substantially uniform thickness ranging from about 15 mils to about 50 mils in thickness. These coating layers 34 and 36 may be applied in various ways, such as but not limited to, spraying the major surfaces of the gypsum boards with the intumescent coating material at the job site or at the factory or using a doctor blade on a production line to level out and set the thickness of a pool of the intumescent coating material distributed on the major surface of the gypsum board being coated prior to passing the gypsum board beneath the doctor blade. While it is preferred to coat the major surfaces of the gypsum boards in the embodiment of FIG. 2, the intumescent material layers 34 and 36 may also be a woven or non-woven fibrous mat coated with an intumescent material coating or a woven or non-woven fibrous mat, e.g. a mat formed by a wet process, with expandable particulate graphite dispersed throughout the mat. In the third embodiment 20*c* of the gypsum board/intumescent material fire wall barrier of the present invention, shown in FIG. 3, the intumescent barrier includes two intumescent coating layers 40 and 42, containing expandable particulate graphite, applied directly to the two major surfaces of a fibrous insulation blanket or batt 44, such as a glass fiber or mineral wool insulation blanket. The fibrous insulation blanket 44 is coextensive in height and width with the cavity defined by the studs 22 and the gypsum board layers 24 and 26 with the fibrous insulation blanket 44, preferably, projecting into the channels of the studs 22, as shown in FIG. 3, where channel shaped studs are used. Preferably, as shown in FIG. 4, the intumescent coating layers 40 and 42 are coextensive in width and height with the major surfaces of fibrous insulation blanket 44 to which the intumescent coating layers are applied so that the intumescent material layers are coextensive in height and width with the cavities defined by the gypsum boards 24 and 26 and the studs 22. Where the insulation blanket 44 projects into the channels of the studs 22 when channel shaped studs are used, the intumescent material layers overlay the inner sidewall surfaces of the studs 22 to which the gypsum boards are affixed by passing screws or other conventional mechanical fasteners through the gypsum boards and into the sidewalls of the studs. Where the intumescent coating layers 40 and 42 do not overlay the inner sidewall surfaces of the studs to which the gypsum board layers are affixed, the outer sidewall surfaces of the studs may be coated with an intumescent material layer. The studs can be either metal or wooden studs.

Preferably, the intumescent material layers 40 and 42 are coating layers of substantially uniform thickness ranging from about 15 mils to about 50 mils in thickness. These coating layers 40 and 42 on the fibrous insulation blanket 44 of FIG. 4 may be applied in various ways, such as but not limited to, spraying the major surfaces of the fibrous insulation blanket 44 with the intumescent coating material at the job site or at the factory or using a doctor blade on a production line to level out and set the thickness of a pool of the intumescent coating material distributed on the major surface of the fibrous insulation blanket being coated prior to passing the fibrous insulation blanket beneath the doctor blade. The intumescent coating layers 40 and 42 on the major surfaces of the fibrous insulation blanket 44 not only provide the intumescent material barrier required for the fire barrier wall 20*c*, but the intumescent material layers 40 and 42 may also enhance the product by stiffening the fibrous insulation blanket (batt) to make the blanket easier to handle and install and by encapsulating the fibers of the fibrous insulation blanket to reduce the exposure of fibers. While an intumescent coating layer on each major surface of the fibrous insulation blanket is preferred, a coating layer may be applied to only one major surface of the blanket.

Figure 5:
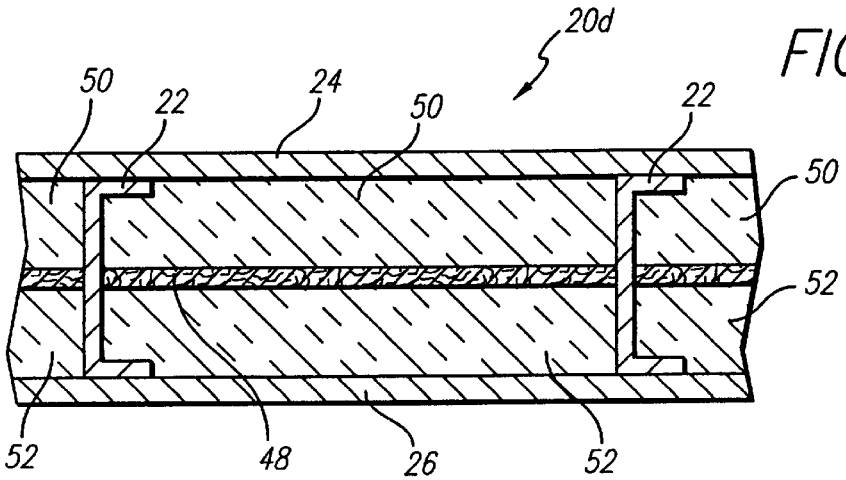
FIG. 5 is a partial transverse horizontal cross section through an embodiment of the gypsum board/intumescent material fire wall of the present invention wherein there is an intumescent material layer sandwiched between two insulation layers, intermediate, midway or substantially midway between the two gypsum board layers (although not shown, the studs may be wooden or metal and separately coated with the intumescent material).
Figure 6:
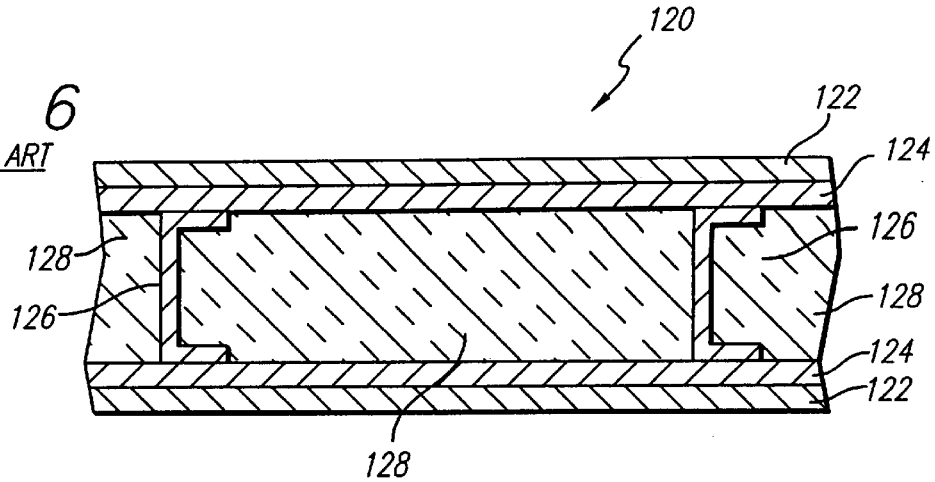
FIG. 6 PRIOR ART
FIG. 6 is a transverse horizontal cross section through a gypsum board fire wall of the prior art which is in current use.

In the fourth embodiment 20*d* of the gypsum board/intumescent material fire barrier wall of the present invention shown in FIG. 5, the intumescent material barrier may be an intumescent material mat layer 48 including a fibrous woven or non-woven mat coated with an intumescent coating containing expandable particulate graphite or a woven or non-woven fibrous mat, e.g. a glass fiber mat of randomly oriented fibers made by a conventional wet process, with expandable particulate graphite dispersed throughout the mat. Preferably, the intumescent material mat layer 48 is sandwiched between fibrous insulation layers 50 and 52 as shown in FIG. 5. However, intumescent material mat layers 48 can be applied directly to the interior or exterior major surfaces of the gypsum boards 24 and 26 as discussed above in connection with FIGS. 1 and 2, or two such intumescent material mat layers 48 can be applied intermediate a fibrous insulation layer and the inner major surfaces of the gypsum board layers 24 and 26 instead of using a coated fibrous insulation blanket as in the embodiment of FIG. 3.

The intumescent material mat layer 48 is coextensive in width and height with the cavity formed by the gypsum board layers 24 and 26 and the studs 22 and, where channel shaped studs are used, may extend into the channels of the studs to which the gypsum board layers are affixed. Where the intumescent material mat layers do not extend into the channels of the studs to which the gypsum board layers are affixed, the outer sidewall surfaces of the studs may be coated with an intumescent material layer.

The preferred intumescent material used in the two hour fire wall of the present invention includes expandable particulate graphite. This preferred intumescent material may be: a coating material containing expandable particulate graphite that is applied directly to major surfaces of the gypsum board; a fibrous insulation blanket, e.g. a glass fiber insulation blanket or batt, coated with a coating material containing expandable particulate graphite; a curtain member or mat, e.g. a wet laid glass fiber mat, coated with a coating material containing expandable particulate graphite;

or a curtain member or mat, e.g. a wet laid glass fiber mat, with expandable particulate graphite dispersed throughout the mat.

Expandable particulate graphite, as used in the preferred intumescent material of the present invention, is prepared from particulate, naturally occurring crystalline flake graphite or crystalline lump graphite, that has been acid treated to make the particulate graphite intumescent. Preferably, the particulate is naturally occurring crystalline flake graphite. In the production of a preferred form of the expandable particulate graphite, it is believed that the treatment of the crystalline flake graphite or crystalline lump graphite with concentrated sulfuric acid in the presence of an oxidizing agent, such as nitric acid, forms the compound graphite sulfate which exfoliates and expands when exposed to a flame or any other heat source having a temperature of about 150° C. or greater. When exposed to temperatures of 150° C. or greater, the expandable particulate graphite used in the intumescent material of the present invention expands from about 20 to about 200 times its unexpanded volume to fill voids and cavities, form firestopping layers, and otherwise form firestopping barriers.

One method of preparing the naturally occurring crystalline flake graphite or crystalline lump graphite to make the particulate graphite expandable is disclosed in U.S. Pat. No. 3,574,644; issued Apr. 13, 1971; Franciszek Olstowski et al (the disclosure of U.S. Pat. No. 3,574,644, is hereby incorporated herein by reference in its entirety). As set forth in the '644 patent, the method includes contacting the particulate graphite, at about room temperature, (1) with a mixture of from about 8 to about 98 weight percent concentrated sulfuric acid (at least about 90 weight percent $H_2SO_4$) and from about 92 to about 2 weight percent concentrated nitric acid (at least about 60 weight percent $HNO_3$), or (2) with fuming nitric acid, or (3) with fuming sulfuric acid, or (4) with concentrated sulfuric acid (at least about 90 weight percent $H_2SO_4$) or concentrated nitric acid (at least 60 weight percent $HNO_3$), plus at least about 2 weight percent of a solid inorganic oxidizer, such as, for example, manganese dioxide, potassium permanganate, potassium chlorate, chromium trioxide, and the like. The resulting mix components usually are employed on a weight proportion basis from about 0.2–2/1 (acid member/graphite). These are maintained in contact for at least about one minute, although a contact time of hours or days is not detrimental. The acid treated graphite particulate, now expandable, is separated from any excess acid, water washed and dried.

In the preferred intumescent material used in the present invention, any residual acid or acid components are removed from the expandable particulate graphite, preferably by washing the expandable particulate graphite with water, to increase the pH of the expandable particulate graphite to about 7.0 and eliminate or essentially eliminate potential corrosive agents from the expandable particulate graphite. If the residual acid or acid components are not removed from the expandable particulate graphite prior to introducing the expandable particulate graphite into and mixing the expandable particulate graphite with the carrier, the corrosion inhibitor (e.g. sodium hexa meta phosphate) in the carrier can change the acid residue or acid components on the expandable particulate graphite into salt so that these corrosive agent is still present in the intumescent material in some form.

In the preferred method of making the intumescent material used in the present invention, after the expandable particulate graphite has been thoroughly washed, the expandable particulate graphite is added to a liquid carrier, such as a coating forming carrier, containing a corrosion inhibitor and, in most embodiments, a filler. As mentioned above, the preferred intumescent material used in the fire barrier wall of the present invention (the carrier with the expandable particulate graphite, the corrosion inhibitor and filler, if used) has a pH greater than 7.0, preferably between about 7.5 and about 10.0 and most preferably, between about 8.0 and about 8.5, to reduce the corrosive properties of the intumescent material with respect to most metals used in the construction industry, except aluminum, (e.g. steel, stainless steel, and copper) and to provide a chemically conducive environment for the corrosion inhibitor to form a protective layer on any metal with which the intumescent material comes in contact to prevent or greatly reduce corrosion. If the pH of the liquid carrier, to which the expandable particulate graphite is to be added, is not within the ranges set forth above, a pH enhancer (basic material), such as but not limited to ammonium hydroxide or other hydroxides, can be added directly to the carrier or applied to the washed expandable particulate graphite, prior to introducing the expandable particulate graphite into the carrier, to bring the intumescent material of the present invention within the required pH range.

Preferably, the corrosion inhibitor, in or added to the carrier, is sodium hexa meta phosphate (which appears to work the best), sodium meta phosphate, sodium silicate or other sodium based phosphate compounds. At the pH levels used in the intumescent material of the present invention (i.e. above 7.0, preferably between about 7.5 and about 10.0 and most preferably, between about 8.0 and about 8.5) the phosphate or silicate precipitates out of the carrier to form a phosphate or silicate corrosion inhibiting layer on a metal surface that prevents oxygen from diffusing onto the metal surface. The corrosion inhibitors, listed above, function to form a protective layer when the pH is above 7.0. However, the corrosion inhibitors listed above, function better to form a protective layer when the pH of the intumescent material is between 7.5 and 10.0 and function best to form a protective layer when the pH level of the intumescent material is between about 8.0 and 8.5. Preferably, the corrosion inhibiting properties of the intumescent material of the present invention meet or exceed the following standards, ASTM C665.

The corrosion inhibitor can be introduced into the carrier in dry or solution form and is present in the carrier in sufficient quantities to form a protective layer on any metal brought into contact with the intumescent material, such as metal screws, nails or other metallic mechanical fasteners, metal studs, piping and other utilities, etc., to prevent or inhibit corrosion. For example, a carrier, such as an acrylic latex carrier, including between about 200 parts per million and about 10,000 parts per million sodium hexa meta phosphate and having a pH between about 7.5 and about 10.0 has been found to produce a satisfactory corrosion inhibiting layer and a carrier, such as an acrylic latex carrier, including between about 1,000 parts per million and about 2,000 parts per million sodium hexa meta phosphate and having a pH between about 8.0 and about 8.5 has been found to produce a satisfactory corrosion inhibiting layer.

The liquid carrier used in the preferred intumescent material of the present invention is a coating forming carrier, such as but not limited to, acrylic latexes, vinyl latexes, butadiene-styrene latexes, alkyl paints, epoxy solutions, urethane solutions, varnishes, lacquers. The viscosity of the carrier can be adjusted, as required, for type of coating or spray application being used, e.g. by regulating the amount of water or solvent added to the carrier.

To reduce the cost of the intumescent material of the present invention, many of the embodiments of the present invention include a filler, preferably an inorganic filler. For example, fillers which can be used in the intumescent material of the present invention include, but are not limited to, calcium carbonate, magnesium carbonate, dolomite and various clays commonly used as fillers.

In embodiments of the preferred intumescent material for the fire barrier wall of the present invention which include a liquid carrier and the expandable particulate graphite, but no fillers, the intumescent material is between about 40 and about 90 weight percent liquid carrier and between about 10 and 60 weight percent expandable particulate graphite. In embodiments of the intumescent material of the present invention which include fillers, the liquid carrier is between about 20 and about 60 weight percent of the intumescent material; the expandable particulate graphite is between about 10 and about 30 weight percent of the intumescent material; and the filler is between about 10 and about 50 weight percent of the intumescent material. In the preferred embodiments of the present invention which include fillers, the liquid carrier is between about 35 and about 55 weight percent of the intumescent material; the expandable particulate graphite is between about 10 and about 20 weight percent of the intumescent material; and the filler is between about 25 and about 45 weight percent of the intumescent material.

In describing the invention, certain embodiments have been used to illustrate the invention and the practices thereof. However, the invention is not limited to these specific embodiments as other embodiments and modifications within the spirit of the invention will readily occur to those skilled in the art on reading this specification. Thus, the invention is not intended to be limited to the specific embodiments disclosed, but is to be limited only by the claims appended hereto.

What is claimed is:

1. A gypsum board/intumescent material fire barrier wall comprising:

spaced apart, vertically extending studs; each of the studs having a first side and a second side;

a first gypsum board layer and a second gypsum board layer; the first gypsum board layer secured to the first side of the studs and the second gypsum board layer secured to the second side of the studs and forming a fire barrier wall with a wall cavity having a width and a height that is defined, in part, by the studs and opposed major surfaces of the first and second gypsum board layers; the wall cavity having only one gypsum board layer on each side of the studs; and an intumescent material barrier, the intumescent material barrier being coextensive in width and height with the width and height of the wall cavity.

2. The gypsum board/intumescent material fire barrier wall according to claim 1, wherein: the intumescent material barrier is a coating containing expandable particulate graphite applied to the opposed major surfaces of the first and second gypsum boards; and the first and second gypsum board layers and the intumescent material barrier provide the fire barrier wall with two hour fire-resistive properties meeting or exceeding ASTM test standard E119 for walls and partitions.

3. The gypsum board/intumescent material fire barrier wall according to claim 2, wherein: the intumescent coating material has a pH greater than 7.0 and a corrosion inhibitor.

4. The gypsum board/intumescent material fire barrier wall according to claim 2, including: a layer of fibrous insulation intermediate the opposed major surfaces of the first and second gypsum board layers and coextensive in width and height with the width and height of the wall cavity.

5. The gypsum board/intumescent material fire barrier wall according to claim 4, wherein: the intumescent coating material has a pH between about 7.5 and about 10.0 and a corrosion inhibitor; a liquid carrier is between about 40 and about 90 weight percent of the intumescent material as applied; and the expandable particulate graphite is between about 10 and about 60 weight percent of the intumescent material as applied.

6. The gypsum board/intumescent material fire barrier wall according to claim 4, wherein: the intumescent coating material has a pH between about 8.0 and about 8.5 and a corrosion inhibitor; a liquid carrier is between about 20 and about 60 weight percent of the intumescent material as applied; and the expandable particulate graphite is expandable flake graphite and is between about 10 and about 30 weight percent of the intumescent material as applied; and an inorganic filler is between about 10 and about 50 weight percent of the intumescent material as applied.

7. The gypsum board/intumescent material fire barrier wall according to claim 1, wherein: the intumescent material barrier is a coating containing expandable particulate graphite applied to the outer major surfaces of the first and second gypsum board layers; and the first and second gypsum board layers and the intumescent material barrier provide the fire barrier wall with two hour fire-resistive properties meeting or exceeding ASTM test standard E119 for walls and partitions.

8. The gypsum board/intumescent material fire barrier wall according to claim 7, wherein: the intumescent coating material has a pH greater than 7.0 and a corrosion inhibitor.

9. The gypsum board/intumescent material fire barrier wall according to claim 8, including: a layer of fibrous insulation intermediate the opposed major surfaces of the first and second gypsum board layers and coextensive in width and height with the width and height of the wall cavity.

10. The gypsum board/intumescent material fire barrier wall according to claim 9, wherein: the intumescent coating material has a pH between about 7.5 and about 10.0 and a corrosion inhibitor; a liquid carrier is between about 40 and about 90 weight percent of the intumescent material as applied; and the expandable particulate graphite is between about 10 and about 60 weight percent of the intumescent material as applied.

11. The gypsum board/intumescent material fire barrier wall according to claim 4, wherein: the intumescent coating material has a pH between about 8.0 and about 8.5 and a corrosion inhibitor; a liquid carrier is between about 20 and about 60 weight percent of the intumescent material as applied; and the expandable particulate graphite is expandable flake graphite and is between about 10 and about 30 weight percent of the intumescent material as applied; and an inorganic filler is between about 10 and about 50 weight percent of the intumescent material as applied.

12. The gypsum board/intumescent material fire barrier wall according to claim 1, wherein: the intumescent material barrier is a fibrous insulation blanket with a coating layer of an intumescent coating material containing expandable particulate graphite on at least one major surface of the fibrous insulation blanket; the fibrous insulation blanket is within the wall cavity intermediate the gypsum board layers; and the first and second gypsum board layers and the intumescent material barrier provide the fire barrier wall with two hour fire-resistive properties meeting or exceeding ASTM test standard E119 for walls and partitions.

13. The gypsum board/intumescent material fire barrier wall according to claim 12, wherein: the intumescent coating material containing expandable particulate graphite is on both major surfaces of the fibrous insulation blanket.

14. The gypsum board/intumescent material fire barrier wall according to claim 12, wherein: the intumescent coating material has a pH between about 7.5 and about 10.0 and a corrosion inhibitor; a liquid carrier is between about 40 and about 90 weight percent of the intumescent material as applied; and the expandable particulate graphite is between about 10 and about 60 weight percent of the intumescent material as applied.

15. The gypsum board/intumescent material fire barrier wall according to claim 12, wherein: the intumescent coating material has a pH between about 8.0 and about 8.5 and a corrosion inhibitor; a liquid carrier is between about 20 and about 60 weight percent of the intumescent material as applied; and the expandable particulate graphite is expandable flake graphite and is between about 10 and about 30 weight percent of the intumescent material as applied; and an inorganic filler is between about 10 and about 50 weight percent of the intumescent material as applied.

16. The gypsum board/intumescent material fire barrier wall according to claim 1, wherein: the intumescent material barrier is a mat with a coating layer of an intumescent coating material containing expandable particulate graphite on at least one of its major surfaces; the mat is coextensive in width and height with the wall cavity; and the first and second gypsum board layers and the intumescent material barrier provide the fire barrier wall with two hour fire-resistive properties meeting or exceeding ASTM test standard E119 for walls and partitions.

17. The gypsum board/intumescent material fire barrier wall according to claim 16, wherein: the mat is intermediate the gypsum board layers.

18. The gypsum board/intumescent material fire barrier wall according to claim 17, wherein: the intumescent coating material has a pH greater than 7.0 and a corrosion inhibitor.

19. The gypsum board/intumescent material fire barrier wall according to claim 17, including: a layer of fibrous insulation intermediate the opposed major surfaces of the first and second gypsum boards and coextensive in width and height with the width and height of the wall cavity.

20. The gypsum board/intumescent material fire barrier wall according to claim 19, wherein: the intumescent coating material has a pH between about 7.5 and about 10.0 and a corrosion inhibitor; a liquid carrier is between about 40 and about 90 weight percent of the intumescent material as applied; and the expandable particulate graphite is between about 10 and about 60 weight percent of the intumescent material as applied.

21. The gypsum board/intumescent material fire barrier wall according to claim 19, wherein: the intumescent coating material has a pH between about 8.0 and about 8.5 and a corrosion inhibitor; a liquid carrier is between about 20 and about 60 weight percent of the intumescent material as applied; and the expandable particulate graphite is expandable flake graphite and is between about 10 and about 30 weight percent of the intumescent material as applied; and an inorganic filler is between about 10 and about 50 weight percent of the intumescent material as applied.

22. The gypsum board/intumescent material fire barrier wall according to claim 1, wherein: the intumescent material barrier is a fibrous mat containing expandable particulate graphite; the fibrous mat is at least coextensive in width and height with the width and height of the wall cavity; and the first and second gypsum board layers and the intumescent material barrier provide the fire barrier wall with two hour fire-resistive properties meeting or exceeding ASTM test standard E119 for walls and partitions.

23. The gypsum board/intumescent material fire wall barrier according to claim 22, wherein: the fibrous mat is intermediate the opposed major surfaces of the first and second gypsum board layers.

24. The gypsum board/intumescent material fire barrier wall according to claim 23, wherein: the expandable particulate graphite is flake graphite and the expandable particulate graphite is dispersed throughout the fibrous mat.

* * * * *